US005647341A

United States Patent [19]

Langman et al.

[11] Patent Number: 5,647,341

[45] Date of Patent: Jul. 15, 1997

[54] GAS BURNER AND FIREPLACE AND METHOD OF COMBUSTION

[75] Inventors: David A. Langman, Nottawa; Eldon R. Hawton, North Bay; Bradley W. Good; Gerald W. Carson, both of Collingwood, all of Canada

[73] Assignee: Heritage Energy Systems, Collingwood, Canada

[21] Appl. No.: 205,930

[22] Filed: Mar. 4, 1994

[51] Int. Cl.[6] ..... F24C 3/00

[52] U.S. Cl. ..... 126/512; 431/125; 239/520

[58] Field of Search ..... 431/125, 171; 126/512; 239/520

[56] References Cited

U.S. PATENT DOCUMENTS

| | | | |
|---|---|---|---|
| 2,516,282 | 7/1950 | Wilton | 239/520 |
| 3,042,109 | 7/1962 | Peterson | 126/512 |
| 3,732,059 | 5/1973 | Goodnight et al. | 431/171 |
| 5,328,356 | 7/1994 | Hawkinson | 126/512 |

FOREIGN PATENT DOCUMENTS

| | | | |
|---|---|---|---|
| 1284766 | 6/1991 | Canada . | |
| 1284767 | 6/1991 | Canada . | |
| 1295899 | 2/1992 | Canada . | |
| 1301627 | 5/1992 | Canada . | |
| 2222671 | 3/1990 | United Kingdom | 126/512 |

*Primary Examiner*—Carroll B. Dority

*Attorney, Agent, or Firm*—Arne I. Fors; D. Doak Horne; Jeffrey T. Imai

[57] ABSTRACT

A gas burner for use in gas fireplaces provides a yellow flickering flame such as that seen in a real wood fire while maintaining a low level of carbon monoxide production. The gas burner is simple in design and compact in size and may be used in either direct vent or gravity vent gas fireplaces. An air baffle plate may be affixed to the rear of the gas burner to maintain the critical balance between primary and secondary combustion air when using liquid propane gas.

9 Claims, 5 Drawing Sheets

GAS BURNER AND FIREPLACE AND METHOD OF COMBUSTION

BACKGROUND OF THE INVENTION

This invention relates to natural gas fireplaces and more particularly, relates to a compact gas burner for use in gas fireplaces to simulate a real wood fire flame.

Natural gas and liquid propane have traditionally been burnt in closed furnaces to efficiently produce heat in residential and commercial buildings. Gas has also been used in open fireplaces to provide the aesthetically pleasing appearance of an open flame without the mess and labour associated with a real wood fire.

In recent years gas stoves have been developed to provide improved efficiency and a more realistic wood-like fire, including a yellow flickering flame. A yellow flame is usually associated with incomplete combustion and unacceptably high levels of carbon monoxide. The Canadian Gas Association standard requires a maximum of 200 ppm carbon monoxide production after an initial start up time of 3 minutes.

Canadian Pat. No. 1,284,767 discloses a gas burner assembly provided to produce a close simulation of a real wood log fire. A gas pipe with downwardly facing orifices discharges gas into a casing filled with granular particles for disseminating the gas flow prior to combustion. In another embodiment the gas discharged from the downwardly facing orifices passes through a gas distribution tile at the top portion of the casing beneath a first and second log member.

In Canadian Pat. No. 1,301,627 a fireplace burner assembly employs inverted U-shaped channels covering an elongated rectangular casing, the central channel or transfer cap being open at one end and partially opened at the opposite end beneath a distribution tile. Uniform distribution of gas along the length of the burner with a real wood fire like flame is achieved.

These and other burner designs shown in the prior art are all rather complicated in design and are comprised of an undue multiplicity of parts.

It is a principal object of the present invention to provide a gas burner assembly for use in gas fireplaces which will simulate the flame pattern of a real wood fire.

Another object of the present invention is to provide a high efficiency gas burner assembly which produces low emissions of carbon monoxide while burning natural gas or liquid propane.

It is yet another object of the invention to provide a compact gas burner assembly for use in smaller fireplaces while maintaining the appearance of multiple flame sources.

It is a further object of the present invention to provide a gas burner assembly operative in either a direct vent or gravity vent fireplace.

SUMMARY OF THE INVENTION

In its broad concept, the gas burner for a fireplace comprises an elongated tubular pipe having opposite ends, said elongated tubular pipe closed at one end and means for communication with a gaseous fuel supply at the opposite end, a plurality of spaced apart primary orifices formed along the elongated tubular pipe facing upwardly for substantially vertical upward discharge of gaseous fuel, a plurality of spaced apart secondary orifices formed along a side of the elongated tubular pipe facing substantially horizontally, and a deflector affixed to the elongated tubular pipe above said secondary orifices and extending upwardly away from the elongated tubular pipe for lateral upward discharge of gaseous fuel. The deflector has a pair of opposing sidewall supports formed at each end of the deflector to encompass the secondary orifices. An elongated upright air baffle may be attached to a side of the elongated tubular pipe opposite to the side containing the secondary orifices. A turbulator pin is vertically diametrically mounted in the elongated tubular pipe at the end in proximity to the means for communication with the gaseous fuel supply. The turbulator pin may be radially adjustable within the elongated tubular pipe.

The gas burner additionally comprises a pair of spaced-apart terraced supports straddling the elongated tubular pipe, and at least three spaced-apart artificial ceramic fiber logs mounted on said supports above and parallel to the elongated tubular pipe, whereby gaseous fuel from the primary orifices can rise between a rear pair of said artificial logs and gaseous fuel from the secondary orifices can rise between a cavity preferably formed between a front pair of said artificial logs.

More particularly, the present invention relates to a gas fireplace comprising a substantially rectangular housing defining a combustion chamber having a base, means for supplying combustion air to said base, a gas burner mounted within said combustion chamber in proximity to the base for receiving combustion air, said gas burner comprising an elongated tubular pipe having opposite ends, said elongated tubular pipe closed at one end and means for communication with a gaseous fuel supply at the opposite end, a plurality of spaced apart primary orifices formed along the elongated tubular pipe facing upwardly for substantially vertical upward discharge of gaseous fuel, a plurality of spaced apart secondary orifices formed along a side of the elongated tubular pipe facing substantially horizontally, a deflector affixed to the elongated tubular pipe above said secondary orifices and extending upwardly away from the elongated tubular pipe for lateral upward discharge of gaseous fuel, a pair of spaced apart terraced supports straddling the elongated tubular pipe, and at least three spaced-apart artificial logs mounted on said supports above and parallel to the elongated tubular pipe, whereby gaseous fuel from the primary orifices can rise between a rear pair of artificial logs and gaseous fuel from the secondary orifices can rise between a front pair of artificial logs for combustion in the combustion chamber, and heat exchanger means formed in an upper portion of the housing for heating and discharging heated convection air.

The present invention also relates to a method of simulating a wood fire in a gas fireplace having a burner comprised of an elongated tubular pipe with means for communication with a gaseous fuel supply, a plurality of spaced-apart primary orifices formed along the elongated tubular pipe facing upwardly, a plurality of spaced-apart secondary orifices formed along a side of the elongated tubular pipe facing substantially horizontally, and a deflector affixed to the elongated tubular pipe above said secondary orifices and extending upwardly and away from the elongated tubular pipe, comprising mounting at least three artificial logs above and parallel to the elongated tubular pipe defining a front log, middle log and rear log arrangement, discharging gaseous fuel with combustion air upwardly from the primary orifices between the middle and rear logs for combustion as rear flames, discharging gaseous fuel and combustion air from the secondary orifices under the deflector upwardly between the front log and middle log for combustion of front flames, and supplying secondary combustion air for substantial completion of combustion of the gaseous fuel.

BRIEF DESCRIPTION OF THE DRAWINGS

The gas stove of the present invention will now be described with reference to the accompanying drawings, in which.

DESCRIPTION OF THE PREFERRED EMBODIMENT

Figure 1:
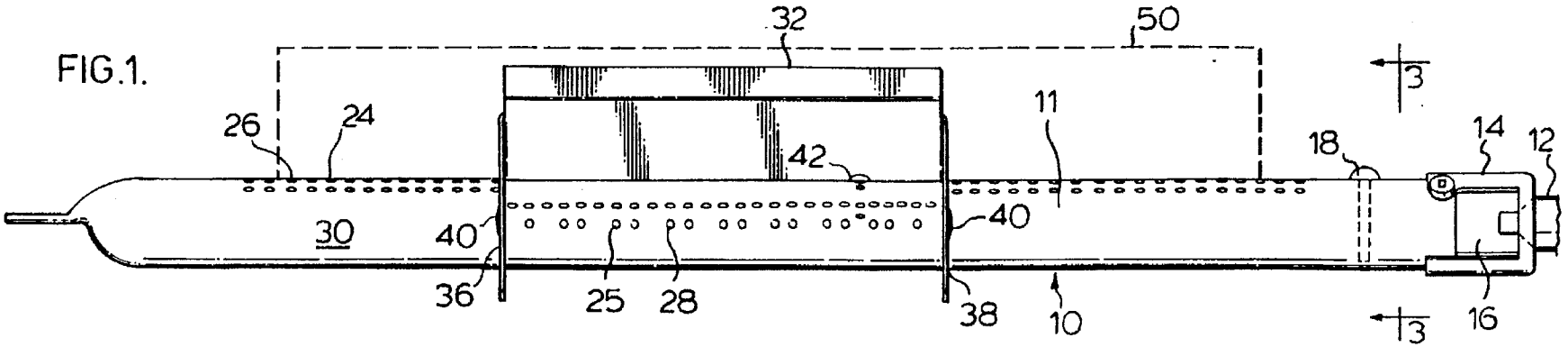
FIG. 1 is a front elevation view of the gas burner of the invention with the air baffle plate affixed to the rear as depicted by ghost lines.
Figure 2:
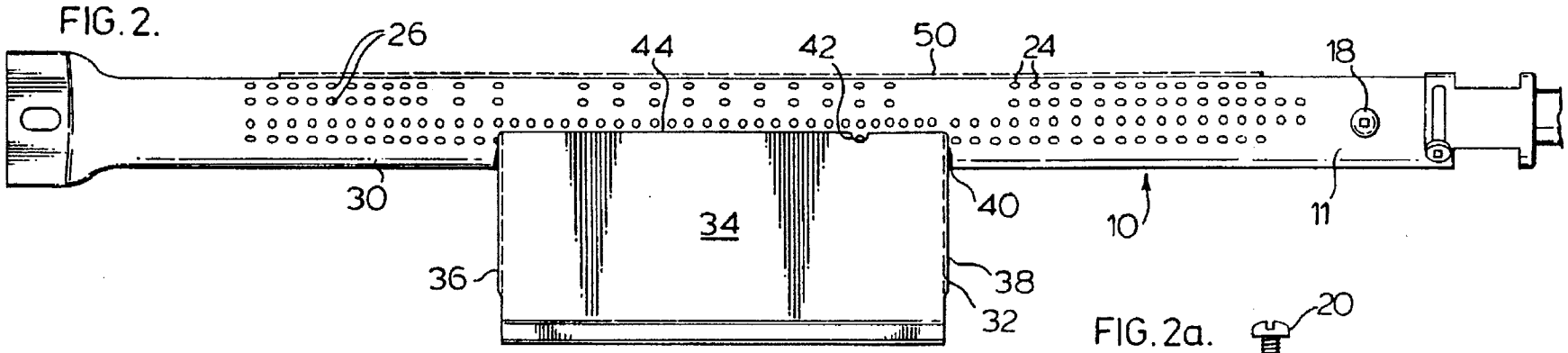
FIG. 2 is a top plan view of the gas burner of FIG. 1.
Figure 3:
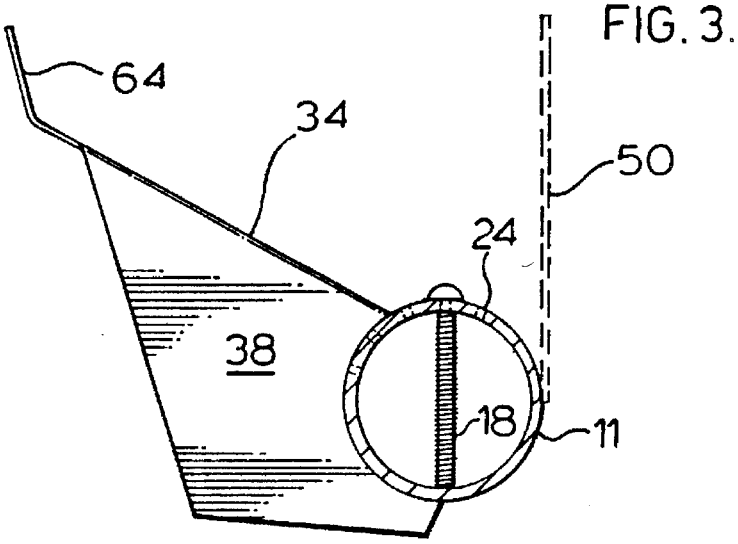
FIG. 3 is a section taken along 3—3 of FIG. 1 showing the turbulator pin.

With reference to FIG. 1–3 of the drawings, the gas burner 10 of the present invention is shown comprising an elongated tube 11 of substantially cylindrical configuration, open at one end for mounting a gas supply orifice 12 in mounting bracket 14 attached to tube 11. Adjacent said gas supply orifice 12 is a pair of opposing apertures 16 formed in bracket 14 to provide a fresh air supply for the burner. A venturi effect provided around the Jet of gas emerging from the gas supply orifice 12 creates a low pressure envelope thereabout to draw fresh air into the gas burner. Said opposing apertures 16 may be fixed in size or variable to provide adjustments for the use of propane or natural gas fuel.

To provide maximum mixing of the air/gas mixture, a turbulator pin 18 is provided in close proximity to the gas supply orifice 12. As the air/gas mixture strikes the turbulator pin 18, the gaseous mixture develops a turbulent flow pattern which greatly enhances mixing of said air/gas mixture and uniform distribution of the mixture along the length of the burner as it travels longitudinally through the gas burner. While FIGS. 1, 2 and 3 show the turbulator pin mounted substantially vertical and diametrically disposed within the gas burner, any position or orientation which creates a turbulent flow pattern will enhance the mixing process.

Figure 2A:
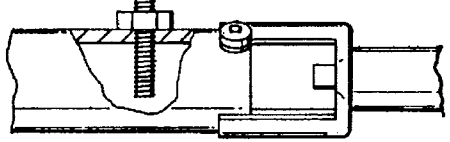
FIG. 2*a* is a top plan view of an embodiment of gas burner for use with propane fuel.

When the gas burner is intended for use with propane gas, the level of turbulence preferably is adjustable for fine tuning. An inwardly depending threaded screw 20 (FIG. 2*a*) in place of the fixed turbulator pin 18 provides variable levels of turbulence by radial inward and outward adjustment of screw 20 in burner tube 11.

A plurality of spaced apart primary orifices 24 are formed in longitudinal rows 26 along the upper surface of the gas burner 10 for substantially vertical upward discharge of said air/gas mixture to provide a first flame source. In the preferred embodiment, said orifices extend to about 2 inches from each end of the tube.

With particular reference now to FIG. 1, additional rows 28 of spaced apart secondary orifices 25 are provided in the central region of the tube on the front side 30 thereof. A flame deflector 32 is longitudinally affixed to the tube 11 in the central region above and to the sides of the additional rows 28 of orifices 25 to provide lateral, i.e. forward, and upward deflection of the air/gas mixture discharging from said additional rows 28 of orifices 25. Said flame deflector 32 preferably is mounted such that top wall 34 diverges upwardly about 20 to 30 degrees from the horizontal. A pair of substantially parallel opposing sidewall supports 36, 38 formed at each end of the flame deflector 32 to encompass secondary orifices 25 are fixedly attached to the front surface 30 of the gas burner, such as by welds 40. An arcuate opening 42 is located at the flame deflector/gas burner juncture 44 to provide a flame continuity and subsequent ignition point for the air/gas mixture emerging from the additional secondary rows 28 of orifices 25.

Figure 5:
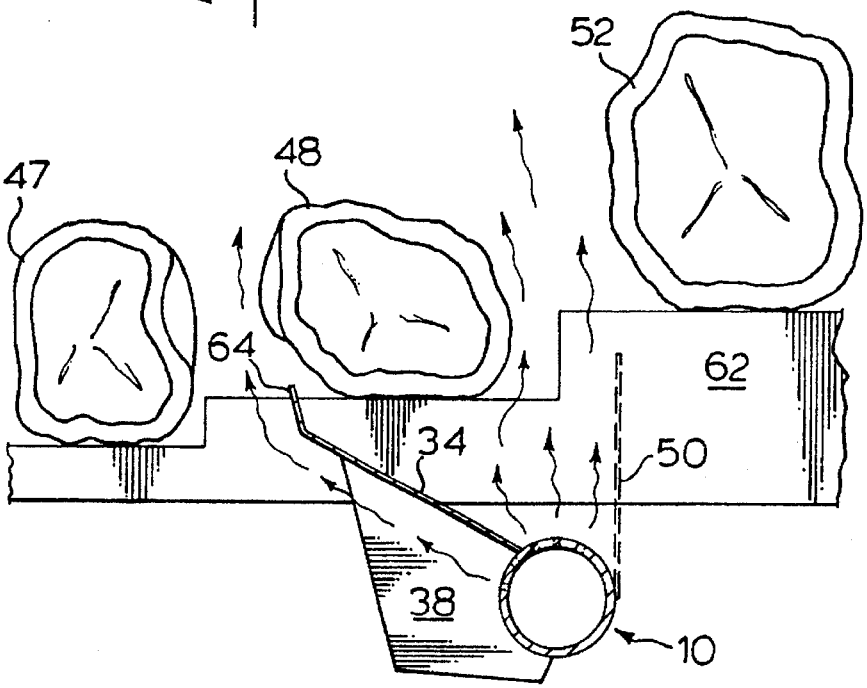
FIG. 5 is a section view corresponding to line 5—5 of FIG. 4 showing the intended flame path around the forwardly positioned log.

The ignited air/gas mixture emerging from the secondary rows 28 of orifices will be contained between the opposing side supports 36, 38 and the top wall 34 of the flame deflector and will travel laterally away from the gas burner to give the appearance of a flame source between artificial logs 47 and 48, as shown in FIG. 5.

An air baffle 50, shown by ghost lines in FIGS. 1–3, preferably is incorporated on the rear of gas burner 10 for burning propane gas. Additional flame travel and preheating of secondary combustion air for delayed combustion of the first flame between logs 48 and 52 maintains the critical balance between primary and secondary combustion air to ensure essentially complete combustion of gaseous fuel to carbon dioxide while providing a yellow flame.

Figure 4:
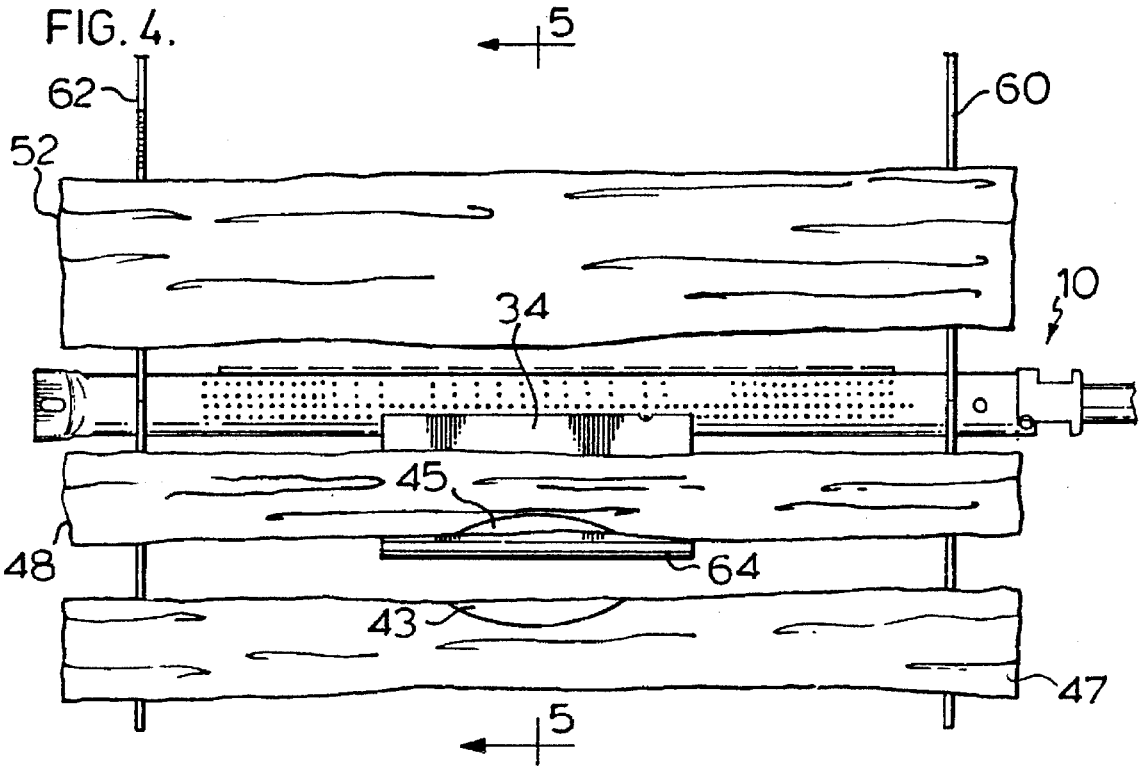
FIG. 4 is a top elevation view of the burner assembly supporting a pair of ceramic logs.

Turning now to FIGS. 4 and 5, artificial ceramic fiber logs 47, 48 and 52 are seated on spaced-apart side supports 60, 62 which straddle elongated tube 11 of burner 10. Side supports 60, 62 are terraced so that rear log 52 is positioned higher than front logs 47 and 48. Upwardly inclined top wall 34 of flame deflector 32 has a substantially vertical distal flange 64 below and in proximity to a cavity formed by cut out 43 in ember log 47 and opposed cut out 45 in middle log 48 such that combustion gases with air discharged from secondary orifices 25 are consumed in front of and against middle log 48 to give the appearance of a burning log 48 opposite front ember log 47. Combustion gases from primary orifices 24 rise between logs 48, 52 for combustion in proximity to the two logs, particularly raised rear log 52, to give the appearance of combustion of the logs. Secondary combustion air rising behind baffle 50, preferably used for burning of propane gas, allows preheating of the secondary combustion air and delay in completion of combustion such that flames between logs 48, 52 burn with a yellow wood-like flame to completion, yielding a low carbon monoxide content in the combustion products.

Figure 6:
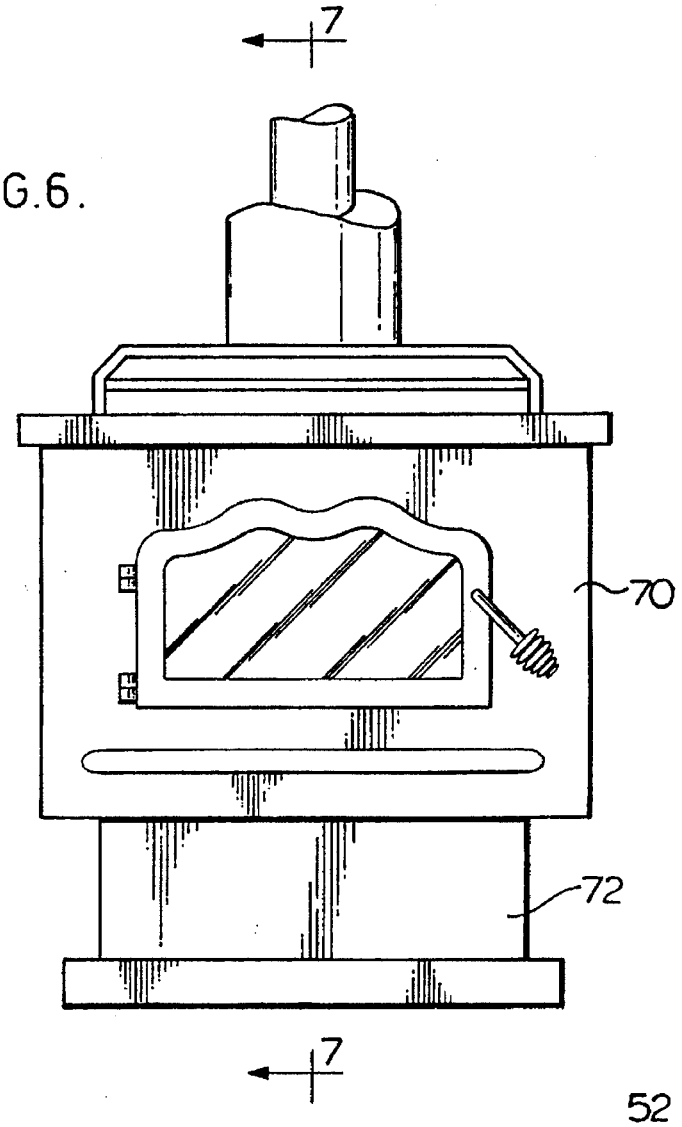
FIG. 6 is a front elevation view of a typical direct vent or gravity vent fireplace employing the invention.
Figure 7:
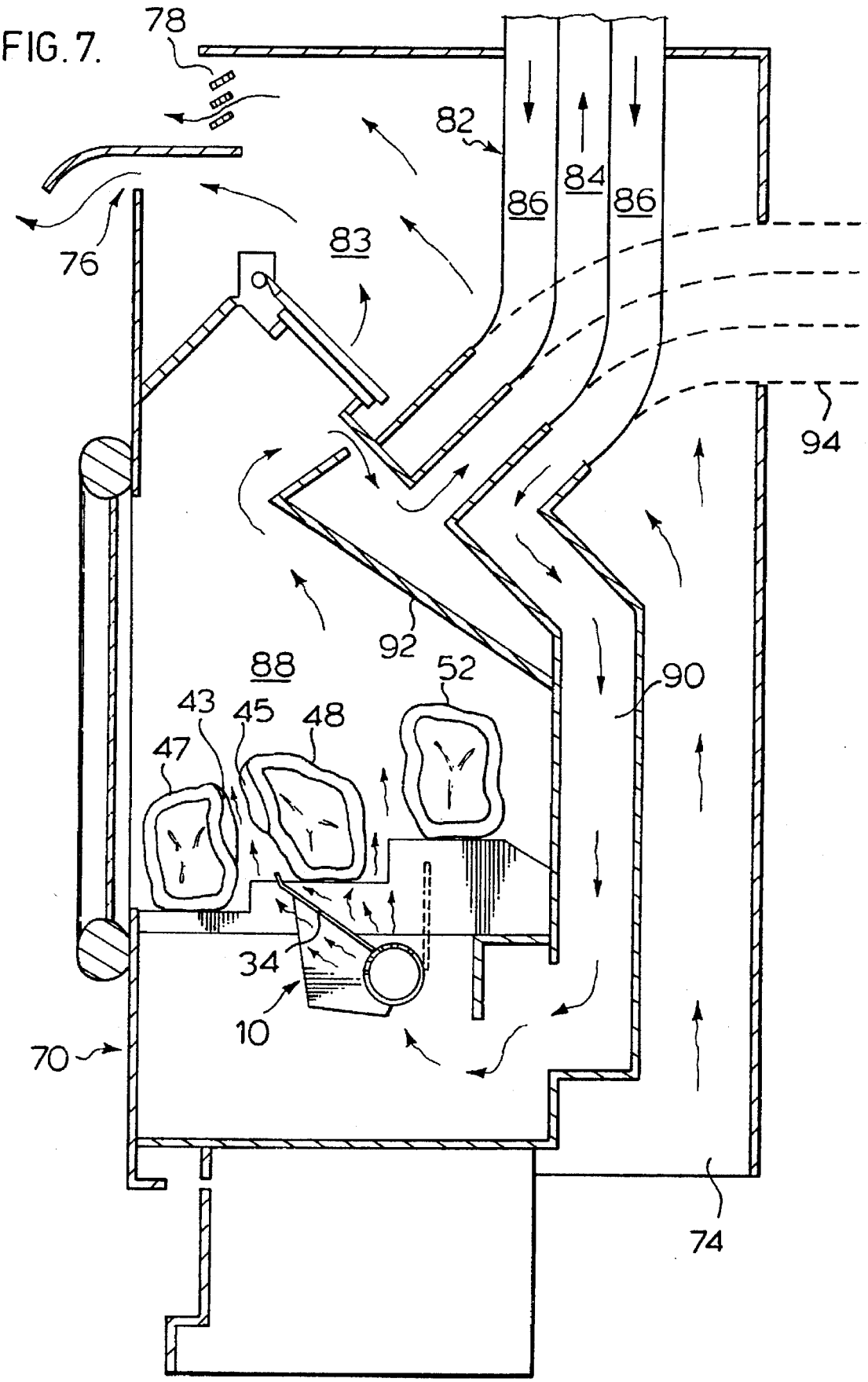
FIG. 7 is a section view taken along line 7—7 of FIG. 6 showing a direct vent application of the invention, also showing an alternative intake/exhaust configuration for extension from the rear of the fireplace, as depicted by ghost lines; and, FIG. 7*a* is a section view taken along line 7—7 of FIG. 6 showing a gravity vent application of the invention depicting an alternative exhaust configuration for extension from the rear of the fireplace, as depicted by ghost lines.
Figure 7A:
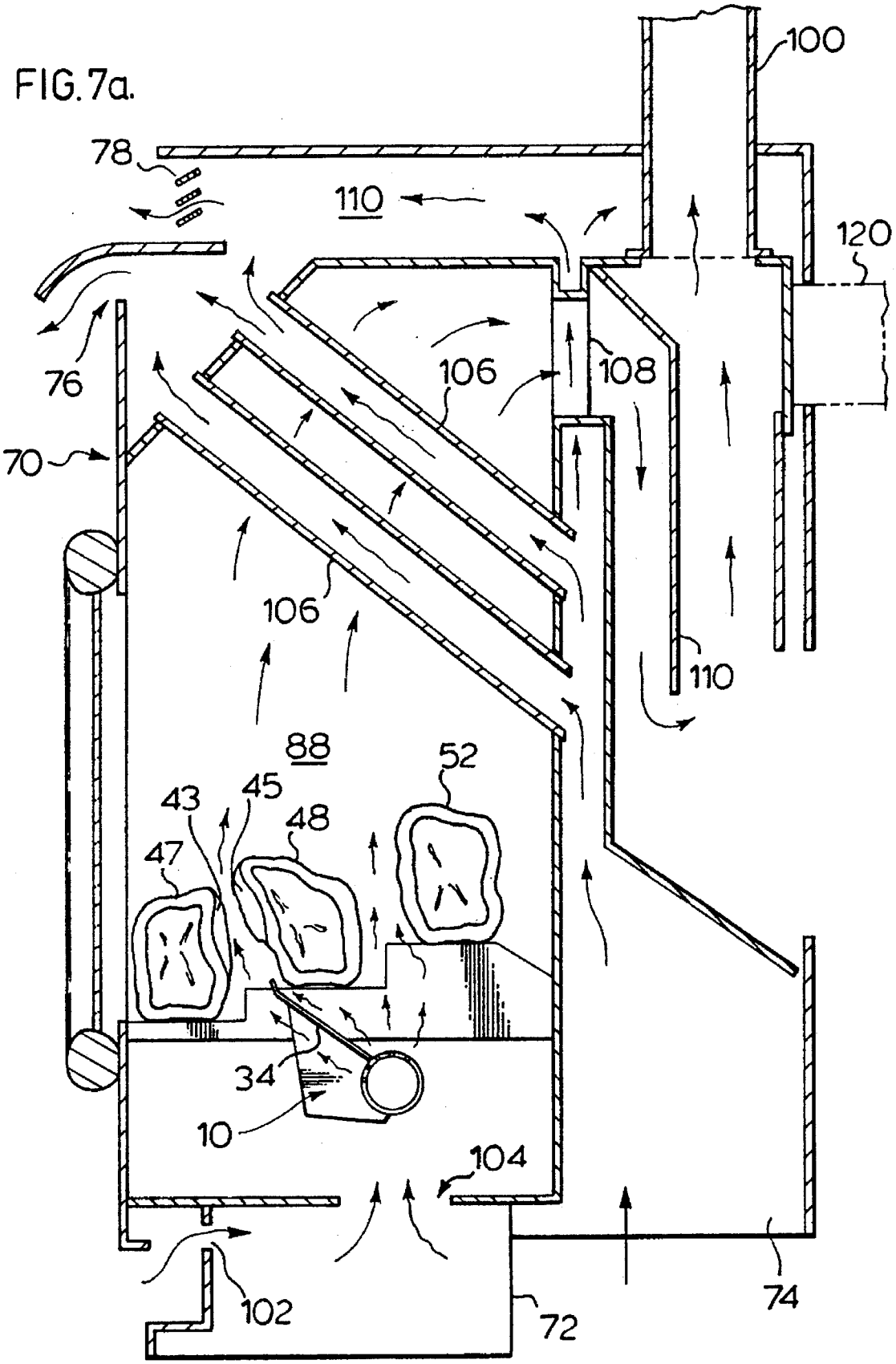

FIGS. 6–7*a* illustrate a gas fireplace, i.e. a free-standing gas stove, which embodies the gas burner of the present invention. Upper housing 70 seated on pedestal 72 has convection air inlets 74 at the bottom rear and convection air outlets 76 and 78 at the upper front. The embodiment shown by the vertical cross-section of FIG. 7 has a vertical direct vent assembly 82 with outlet duct 84 concentric within an inlet annulus 86. Combustion air enters the combustion chamber 88 through inlet annulus 86 into duct 90 and then upwardly through and about burner 10 for partial primary combustion with a yellow flame of the gas/air mixture from burner 10 followed by completion of combustion with secondary combustion air before discharge from chamber 88. Combustion products pass upwardly around baffle 92 into inner outlet duct 84. The alternative configuration shown by ghost lines 94 in FIG. 7 permits a horizontal rear direct venting of combustion products and introduction of combustion air.

Convection air entering through bottom inlet 74 passes upwardly past vent assembly 82 and about the shell of combustion chamber 88 into upper chamber 83 for heating prior to discharge as heating air out of vents 76 and 78.

The embodiment shown in the vertical cross-section of FIG. *7a* has a vertical exhaust stack 100 for discharge of combustion products. Combustion air enters the stove through front bottom inlet 102 and passes upwardly through base opening 104 into burner 10. Gaseous fuel and air are mixed and reacted in chamber 88 and the combustion products discharged upwardly past a plurality of inclined heat exchange tubes 106 and a plurality of vertical heat exchange tubes 108 before being deflected downwardly by baffle 110 prior to discharge through stack 100. Convection air entering through bottom inlet 74 passes upwardly by gravity through heat exchange ducts 106 and 108 into upper chamber 100 before discharge as heating air out of vents 76 and 78. Ghost lines 120 depict a horizontal rear discharge of combustion products.

It will be understood that modifications can be made in the embodiment of the invention illustrated and described herein without departing from the scope and purview of the invention as defined by the appended claims.

We claim:

1. A gas burner for a fireplace comprising: an elongated tubular pipe having opposite ends, said elongated tubular pipe closed at one end and means for communication with a gaseous fuel supply at the opposite end, a plurality of spaced apart primary orifices formed along the elongated tubular pipe facing upwardly for substantially vertical upward discharge of gaseous fuel, a plurality of spaced apart secondary orifices formed along a side of the elongated tubular pipe facing substantially horizontally, and an elongated deflector affixed in its elongated direction to the elongated tubular pipe above said secondary orifices to encompass the secondary orifices and extending upwardly away from the elongated tubular pipe for lateral upward discharge or gaseous fuel from the secondary orifices.

2. A gas burner as claimed in claim 1, in which said deflector has a pair of opposing sidewall supports formed at each end of the deflector to encompass the secondary orifices.

3. A gas burner as claimed in claim 2, comprising a turbulator pin vertically diametrically mounted in the elongated tubular pipe at the end in proximity to means for communication with the gaseous fuel supply.

4. A gas burner as claimed in claim 3, in which said turbulator pin is radially adjustable within the elongated tubular pipe.

5. A gas burner as claimed in claim 3 comprising an elongated upright air baffle attached to a side of the elongated tubular pipe opposite to the side containing the secondary orifices.

6. A gas burner as claimed in claim 3 additionally comprising a pair of spaced apart terrace supports straddling the elongated tubular pipe, and at least three spaced-apart artificial logs mounted on said supports above and parallel to the elongated tubular pipe, whereby gaseous fuel from the primary orifices can rise between a rear pair of artificial logs and gaseous fuel from the secondary orifices can rise between a front pair of artificial logs.

7. A gas burner as claimed in claim 6, in which a cavity is formed between said front pair of artificial logs.

8. A gas fireplace comprising a substantially rectangular housing defining a combustion chamber having a base, means for supplying combustion air to said base, a gas burner mounted within said combustion chamber in proximity to the base for receiving combustion air, said gas burner comprising an elongated tubular pipe having opposite ends, said elongated tubular pipe closed at one end and means for communication with a gaseous fuel supply at the opposite end, a plurality of spaced-apart primary orifices formed along the elongated tubular pipe facing upwardly for substantially vertical upward discharge of gaseous fuel, a plurality of spaced-apart secondary orifices formed along a side of the elongated tubular pipe facing substantially horizontally, and a deflector affixed to the elongated tubular pipe above said secondary orifices and extending upwardly away from the elongated tubular pipe for lateral upward discharge of gaseous fuel, and a pair of spaced-apart terrace supports straddling the elongated tubular pipe, and at least three spaced-apart artificial logs mounted on said supports above and parallel to the elongated tubular pipe, whereby gaseous fuel from the primary orifices can rise between a rear pair of artificial logs and gaseous fuel from the secondary orifices can rise between a front pair of artificial logs, and heat exchanger means formed in an upper portion of the housing for heating and discharging convection air.

9. A method for simulating a wood fire in a gas fireplace having a burner comprised of an elongated tubular pipe with means for communication with a gaseous fuel supply, a plurality of spaced-apart primary orifices formed along the elongated tubular pipe facing upwardly, a plurality of spaced-apart secondary orifices formed along a side of the elongated tubular pipe facing substantially horizontally, and a deflector affixed to the elongated tubular pipe above said secondary orifices and extending upwardly and away from the elongated tubular pipe, comprising mounting at least three artificial logs above and parallel to the elongated tubular pipe defining a front log, middle log and rear log arrangement, discharging gaseous fuel with combustion air upwardly from the primary orifices between the middle and rear logs for combustion as rear flames, discharging gaseous fuel and combustion air from the secondary orifices under the deflector upwardly between the front log and middle log for combustion of front flames, and supplying secondary combustion air for substantial completion of combustion of the gaseous fuel.

* * * * *